US006042151A

United States Patent [19]

Ali

[11] Patent Number: 6,042,151

[45] Date of Patent: Mar. 28, 2000

[54] SINGLE SHEET SANDPAPER DELIVERY SYSTEM WITH SINGLE SHEET SANDPAPER HAVING APPLICATION COORDINATING INDICIA AND LEGEND

[76] Inventor: Terry Ali, 611 Yellow Springs-Fairfield Rd., Fairborn, Ohio 45324

[21] Appl. No.: 09/131,966

[22] Filed: Aug. 11, 1998

[51] Int. Cl.[7] ..... B42D 15/00

[52] U.S. Cl. ..... 283/115; 283/48.1; 283/56

[58] Field of Search ..... 451/526–539; 206/215, 499, 372, 373, 555; 281/35; 283/115, 48.1, 56

[56] References Cited

U.S. PATENT DOCUMENTS

| | | | |
|---|---|---|---|
| 4,626,050 | 12/1986 | Davis | 206/499 |
| 4,893,438 | 1/1990 | Fry et al. | 451/526 |
| 4,919,290 | 4/1990 | Wadel | 206/555 |
| 4,982,839 | 1/1991 | Stevens | 206/215 |
| 5,367,839 | 11/1994 | Pearce | 451/526 |
| 5,772,251 | 6/1998 | Fleck | 283/115 |
| 5,860,517 | 1/1999 | Gemma, Jr. et al. | 206/63.3 |

OTHER PUBLICATIONS

This Old House Magazine Article, Mar. 1996.

*Primary Examiner*—Willmon Fridie, Jr.
*Assistant Examiner*—George Nguyen
*Attorney, Agent, or Firm*—R. William Graham

[57] ABSTRACT

A sandpaper system with single sheet sandpaper having application coordinating indicia and legend printed thereon includes a first plurality of stacked single sandpaper sheets, wherein a first side of each sandpaper sheet of the first plurality has grit of a first size adhered thereto and has printed on a second side first indicia specifying the first grit size on one portion of the second side and a first application legend on a second portion of the second side specifying a series of grit size groupings wherein each grouping has an associated sanding application specified and wherein each grouping includes a predetermined range of grit sizes exclusive of the other groupings and the first indicia corresponds to only a first one of the groupings, and a second plurality of stacked single sandpaper sheets, wherein a first side of each sandpaper sheet of the second plurality has grit of a second size different from the first grit size which is adhered thereto and has printed on a second side second indicia specifying the second grit size on one portion of the second side and a second application legend on a second portion of the second side which is identical to the first application legend and wherein the second indicia corresponds to only a second one of the groupings.

2 Claims, 2 Drawing Sheets

SINGLE SHEET SANDPAPER DELIVERY SYSTEM WITH SINGLE SHEET SANDPAPER HAVING APPLICATION COORDINATING INDICIA AND LEGEND

BACKGROUND OF THE INVENTION

1. Field of the Invention

The present invention relates to the field of sandpaper. More particularly, the invention relates to a single sheet sandpaper system with single sheet sandpaper having application coordinating indicia and legend.

2. Related Art

In the field of sandpaper delivery systems, there has been increased need for single sheet delivery of sandpaper to the consumer. Single sheet sandpaper selectivity has met with great success due to the need of only a few sheets of various sized grit of sandpaper in order to sand a particular project and obtain a suitable finish. Increased numbers of women in the do-it-yourself home project's market have partly led to this need.

Unfortunately after selecting the planned required sheets to accomplish such project, the consumer leaves the retail delivery system only to arrive home with a variety of sandpaper and no adequate system to explain how to utilize the sandpaper sheets with which one departed because many of the sheets look alike to the novice and result in misuse and a decreased finish in the product.

There remains a need to improve the art. Namely, there is a need to aid the consumer in using sandpaper in a manner in which it was intended and prevent waste.

BRIEF SUMMARY OF THE INVENTION

It is an object to improve single sheet sandpaper delivery systems.

It is another object to provide a user friendly sandpaper and delivery system.

It is yet another object to prevent waste of sandpaper.

It is a further object of the present invention to provide a novel single sheet sandpaper article of manufacture which aids the consumer in their ability to properly prepare and finish articles to be sanded.

Accordingly, the present invention is directed to a single sheet sandpaper delivery system with single sheet sandpaper having application coordinating indicia and legend printed thereon. The system includes a first plurality of stacked single sandpaper sheets, wherein a first side of each sandpaper sheet of the first plurality has grit of a first size adhered thereto and has printed on a second side first indicia specifying the first grit size on one portion of the second side and a first application legend on a second portion of the second side specifying a series of grit size groupings wherein each grouping has an associated sanding application specified and wherein each grouping includes a predetermined range of grit sizes exclusive of the other groupings and the first indicia corresponds to only a first one of the groupings. The system also includes a second plurality of stacked single sandpaper sheets, wherein a first side of each sandpaper sheet of the second plurality has grit of a second size different from the first grit size which is adhered thereto and has printed on a second side second indicia specifying the second grit size on one portion of the second side and a second application legend on a second portion of the second side identical to the first application legend and wherein the second indicia corresponds to only a second one of the groupings.

Other objects and advantages will be readily apparent to those skilled in the art upon viewing the drawings and reading the detailed description hereafter.

DETAILED DESCRIPTION OF THE INVENTION

Figure 1:
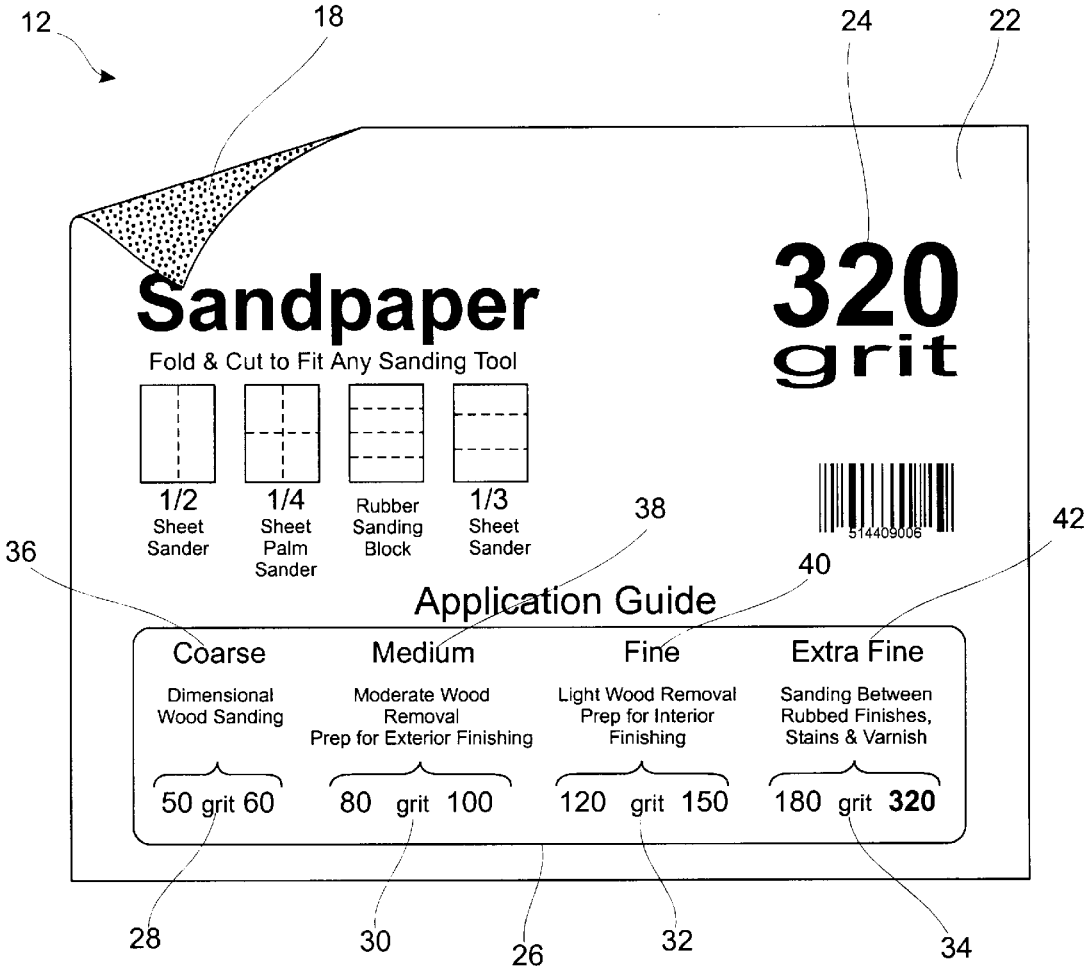
FIG. 1 is a view of a backing of a sheet of sandpaper of the delivery system of the present invention with a corner thereof rolled over depicting a grit surface.
Figure 2:
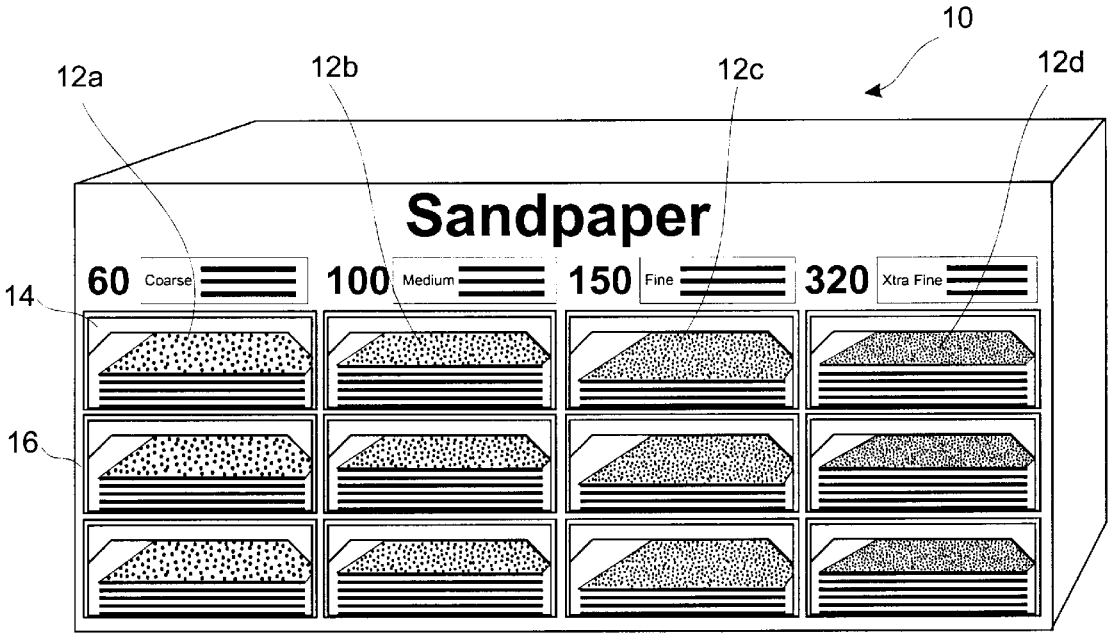
FIG. 2 is a perspective view of the single sheet sandpaper delivery system having the sandpaper of the present invention disposed therein.
Figure 3:
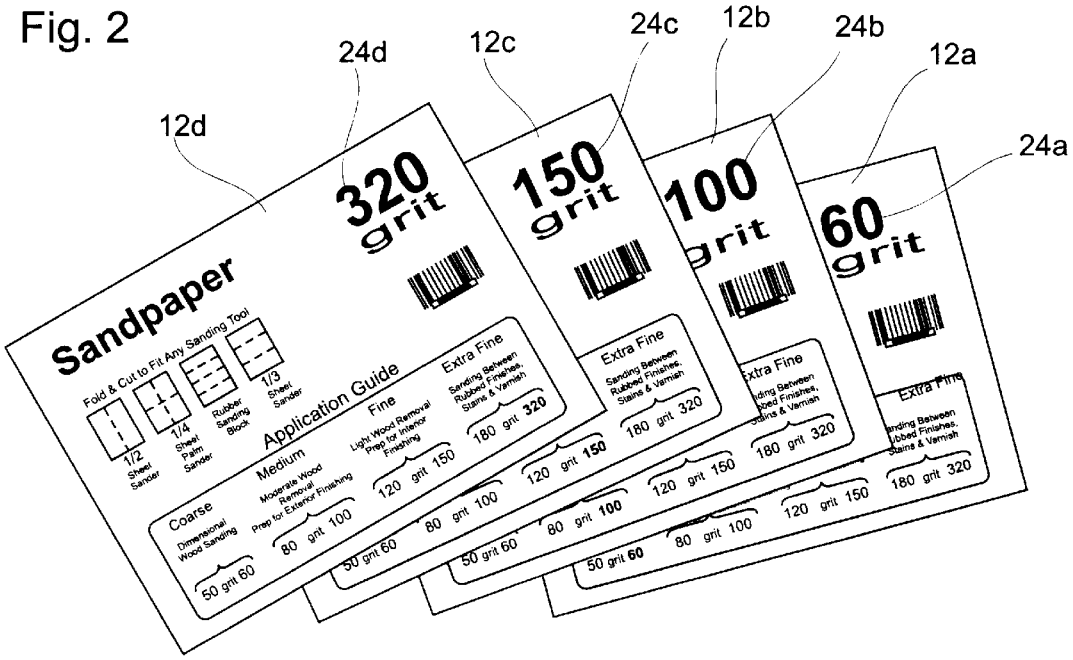
FIG. 3 is a view of a plurality of different type grit sandpaper of the present invention having application coordinating indicia and legend thereon which have been taken from the delivery system in FIG. 2 and assembled for use in a particular project.

Referring to the drawings, the single sheet sandpaper delivery system with single sheet sandpaper is generally referred to by the numeral 10. The single sheet sandpaper delivery system 10 includes a variety of stacked single sheet sandpaper 12 which are arranged preferably within single sheet delivery packages 14 which are disposed in trays or shelves 16.

The single sheet sandpaper 12 has a working surface 18 with a grit 20 formed thereon. A back surface 22 is formed with a printable surface having application coordinating indicia 24 and legend 26 printed thereon. The single sheet sandpaper 12*a*, 12*b*, 12*c* and 12*d* each have a unique grit size formed on their respective working surfaces 18*a–d*. The grit may be of a type known in the art, such as garnet, aluminum oxide etc. to sand a particular substrate.

For example, single sheet sandpaper 12*d* has a first size of grit, e.g. 320, adhered thereto and has printed on a side 22*d* indicia 24*d* specifying the first grit size 320 on one portion thereof and an application legend 26*d* on a second portion thereof specifying a series of grit size groupings 28, 30, 32 and 34 wherein each grouping 28, 30, 32 and 34 has an associated sanding application 36, 38, 40 and 42 specified.

Each grouping 28, 30 and 32 and 34 includes a predetermined range of grit sizes exclusive of the other and the indicia 24*d*, here for example, corresponds to only one of the grouping, in this case sanding application 42. Each of the other sheets 12*a–c* are similarly formed save for the grit of a size different from the other and indicia 24*a–c* specifying the respective grit size which corresponds to only one of the groupings, 40, 38 and 36, respectively.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A sandpaper system with single sheet sandpaper having application coordinating indicia and legend printed thereon, which includes:

a first plurality of stacked single sandpaper sheets, wherein a first side of each sandpaper sheet of the first plurality has grit of a first size adhered thereto and has printed on a second side first indicia specifying the first grit size on one portion of the second side and a first application legend on a second portion of the second side specifying a series of grit size groupings wherein each grouping has an associated sanding application specified and wherein each grouping includes a predetermined range of grit sizes exclusive of the other groupings and the first indicia corresponds to only a first one of the groupings; and a second plurality of stacked single sandpaper sheets, wherein a first side of each sandpaper sheet of the second plurality has grit of a second size different from the first grit size and adhered thereto and has printed on a second side second indicia specifying the second grit size on one portion of the second side and a second application legend on a second portion of the second side identical to the first application legend and wherein the second indicia corresponds to only a second one of the groupings.

2. A sandpaper system with single sheet sandpaper having application coordinating indicia and legend printed thereon, which includes:

a first single sandpaper sheet having grit of a first size adhered thereto and has printed on a second side first indicia specifying the first grit size on one portion of the second side and a first application legend on a second portion of the second side specifying a series of grit size groupings wherein each grouping has an associated sanding application specified and wherein each grouping includes a predetermined range of grit sizes exclusive of the other groupings and the first indicia corresponds to only a first one of the groupings; and a second single sandpaper sheet having grit of a second size different from the first grit size and adhered thereto and has printed on a second side second indicia specifying the second grit size on one portion of the second side and a second application legend on a second portion of the second side identical to the first application legend and wherein the second indicia corresponds to only a second one of the groupings.

* * * * *